US007611339B2

(12) United States Patent
Tetzlaff et al.

(10) Patent No.: US 7,611,339 B2
(45) Date of Patent: Nov. 3, 2009

(54) TRI-LINE POWER CABLE FOR ELECTRICAL SUBMERSIBLE PUMP

(75) Inventors: Steven K. Tetzlaff, Owasso, OK (US); Larry J. Parmeter, Broken Arrow, OK (US); Ed L. Doty, Claremore, OK (US); Rob A. Coyle, Owasso, OK (US); Thomson H. Wallace, Claremore, OK (US); Larry V. Dalrymple, Claremore, OK (US); David H. Neuroth, Claremore, OK (US)

(73) Assignee: Baker Hughes Incorporated, Houston, TX (US)

( * ) Notice: Subject to any disclaimer, the term of this patent is extended or adjusted under 35 U.S.C. 154(b) by 793 days.

(21) Appl. No.: 11/211,896

(22) Filed: Aug. 25, 2005

(65) Prior Publication Data

US 2007/0046115 A1 Mar. 1, 2007

(51) Int. Cl.
*F04B 17/00* (2006.01)
*E21B 23/14* (2006.01)

(52) U.S. Cl. ..... 417/422; 417/423.3; 166/65.1; 166/66.4; 174/105 R; 174/120 R; 439/274; 439/275

(58) Field of Classification Search ..... 166/65.1, 166/369, 66.4; 310/71, 87; 417/423.2, 423.3, 417/422; 439/274, 275; 174/50.51, 50.52, 174/50.53, 50.54, 521, 120 R, 105 R
See application file for complete search history.

(56) References Cited

U.S. PATENT DOCUMENTS

| | | | | |
|---|---|---|---|---|
| 3,952,218 | A | 4/1976 | Deters | |
| 4,053,196 | A | 10/1977 | Dunaway | |
| 4,104,481 | A | 8/1978 | Wilkenloh et al. | |
| 4,128,735 | A | 12/1978 | Zehren | |
| 4,456,844 | A | 6/1984 | Yamamoto et al. | |
| 4,679,875 | A | 7/1987 | Ramsey | |
| 5,191,173 | A * | 3/1993 | Sizer et al. | 174/105 R |
| 5,414,217 | A * | 5/1995 | Neuroth et al. | 174/120 R |
| 5,567,170 | A | 10/1996 | Kroeber | |
| 5,700,161 | A | 12/1997 | Plummer et al. | |
| 5,782,301 | A * | 7/1998 | Neuroth et al. | 166/302 |
| 6,179,585 | B1 | 1/2001 | Kobylinski et al. | |
| 6,260,615 | B1 * | 7/2001 | Dalrymple et al. | 166/60 |
| 6,298,917 | B1 | 10/2001 | Kobylinski et al. | |
| 6,397,945 | B1 * | 6/2002 | Manke et al. | 166/65.1 |
| 6,409,485 | B1 | 6/2002 | Ebner | |
| 6,455,769 | B1 | 9/2002 | Belli et al. | |
| 6,695,062 | B2 | 2/2004 | Dalrymple et al. | |
| 6,910,870 | B2 | 6/2005 | Ebner | |
| 2002/0092667 | A1 * | 7/2002 | Dalrymple et al. | 174/102 R |
| 2004/0120837 | A1 | 6/2004 | Ebner | |

* cited by examiner

*Primary Examiner*—Devon C Kramer
*Assistant Examiner*—Leonard J Weinstein
(74) *Attorney, Agent, or Firm*—Bracewell & Giuliani LLP

(57) ABSTRACT

A power line for an electrical submersible pump has three metallic impermeable tubes. A single electrical conductor is located within each of the tubes. Each conductor has at least one elastomeric insulation layer surrounding it. An annular portion of the insulation layer of each of the electrical conductors is in tight contact with the tube to form a seal. The annular portions may be annular crimps formed in the tube at intervals. The annular portion could also be a continuous seal caused by swelling of the insulation layer due to contact with a hydrocarbon.

19 Claims, 5 Drawing Sheets

TRI-LINE POWER CABLE FOR ELECTRICAL SUBMERSIBLE PUMP

FIELD OF THE INVENTION

The invention relates in general to electrical submersible pump assemblies, and in particular to a power cable for supplying power to the pump motor.

BACKGROUND OF THE INVENTION

A common type of electrical submersible pump comprises a centrifugal pump suspended on a string of tubing within a casing of the well. The pump is driven by a downhole electrical motor, normally a three-phase AC type. A power line extends from a power source at the surface alongside the tubing to the motor to supply power.

Typically the power line is made up of two sections, a motor lead and a power cable. The motor lead has a plug on its lower end that secures to a receptacle known as a "pothead" at the upper end of the electrical motor. The motor lead has three conductors that are insulated and located within a single elastomeric jacket that is extruded around the assembled insulated conductors. Metallic outer armor may wrap around the jacket of the motor lead to avoid damage to the motor lead while running the pump assembly into the well. The motor lead extends upward beyond the pump, for example from 10 to 80 ft. The total of the motor lead and pothead is known as the motor lead extension (MLE). The lead could exceed 80 ft or be shorter than 10 ft depending on the application. A splice connects the motor lead to the power cable. The motor lead is flat and smaller in dimension than the power cable so that it can pass between the pump assembly and the casing.

The power cable comprises three conductors, each having one or more layers of insulation. An elastomeric jacket is usually extruded over the assembled conductors. In some cases, the insulated conductors are encased in lead. The insulated conductors are arranged either in a flat side-by-side configuration, or in a round configuration spaced 120 degrees apart from each other relative to a longitudinal axis of the power cable. A metallic armor is typically wrapped around the jacket to form the exterior of the power cable.

In some wells, the formation temperature is quite hot. Also, the motor generates heat. At least one of the insulation layers of each conductor may be formed of a polymer that is resistant to high temperature degradation. However, current high temperature polymer materials may not be capable of withstanding the high temperatures and harsh environments in some wells. If the insulation degrades, a short could result that would require the pump assembly to be pulled and replaced.

In some wells, rather than suspending the pump assembly on the production tubing through which the pump discharges, coiled tubing is employed. Production tubing is made up of sections of pipe secured together by threads. Coiled tubing comprises metal tubing that is unreeled from a reel at the surface while the pump assembly is being installed. The coiled tubing encases the entire power cable and provides sufficient strength to support the weight of the pump. The pump discharges into a casing or liner surround the coiled tubing.

SUMMARY OF THE INVENTION

In this invention, at least the motor lead is configured such that each insulated conductor is located within a separate metallic impermeable tube. Preferably each conductor has at least two layers of insulation, at least one of which resists high temperatures. An annular portion of the insulation layer of each of the electrical conductors is in tight contact with the tube to form a seal with the tube. If well fluid enters into the tube where it is spliced to the power cable because of a leak in the tube, the seals will prevent the well fluid from migrating through the entire length of the motor lead.

In one embodiment, the annular portion comprises a crimp that is formed in each of the tubes. The crimps are spaced apart from each other at selected intervals. Initially, a clearance exists between portions of the insulation layer in each of the tubes other than at the seals. The clearance provides expansion room to accommodate thermal expansion of the insulation layer.

In another embodiment, a dielectric oil is pumped between the outer insulation layer and the tube to swell the insulation layer to form a tight seal. The use of oil may be employed with the crimps or it may be utilized alone.

In one embodiment, only the motor lead is made up with three separate metal tubes, each containing one of the three conductors. The power cable is conventional. The motor lead is subject to higher temperatures than the remaining portions of the power cable because of its proximity to the motor and the greater depth in the well.

DETAILED DESCRIPTION OF THE PREFERRED EMBODIMENT

Figure 1:
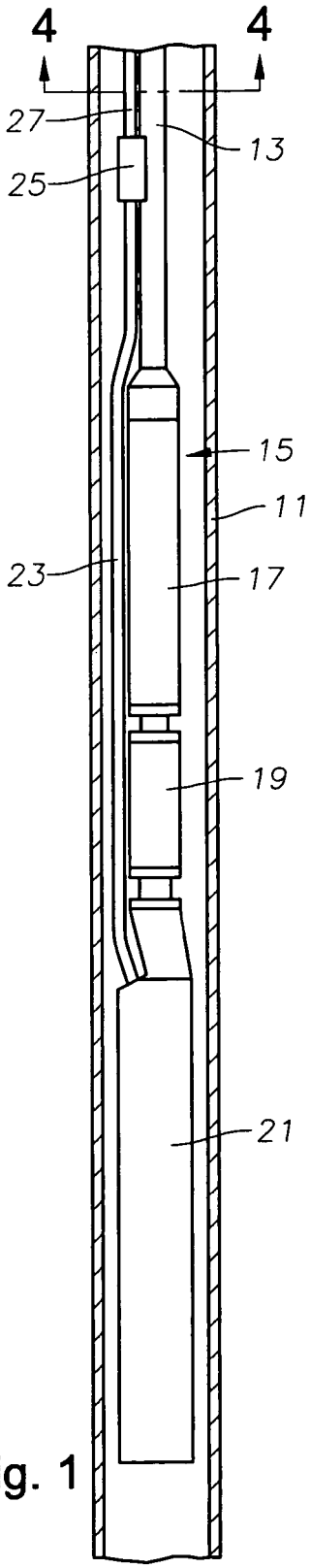
FIG. 1 is a schematic sectional view of an electrical submersible pump assembly having a motor lead constructed in accordance with this invention.

Referring to FIG. 1, a well having a casing 11 is shown. A string of production tubing 13 extends into casing 11. A pump assembly 15 is secured to the lower end of tubing 13 for pumping well fluid up tubing 13 to the surface.

Pump assembly 15 has a pump 17 of conventional design. Pump 17 may be a centrifugal pump having a large number of stages, each stage having an impeller and a diffuser. Alternately, pump 17 could be another type such as a progressing cavity pump, a gas compressor or a turbine pump. Pump 17 has a seal section 19 on its lower end that connects to a motor 21. Seal section 19 equalizes the hydrostatic pressure of fluid in casing 11 with lubricant within motor 21. Motor 21 is normally a three-phase AC motor.

Figure 4:
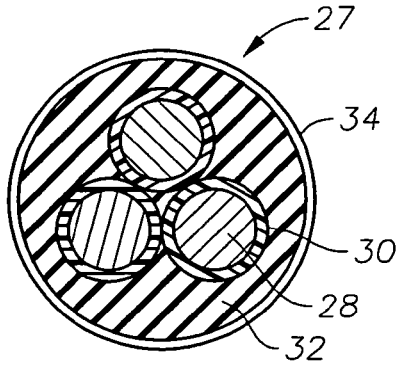
FIG. 4 is a sectional view of the power cable of FIG. 1, taken along the line 4-4 of FIG. 1.

A power line comprising a motor lead 23 and a power cable 27 supplies electrical power to motor 21. Motor lead 23 has a lower end that connects to motor 21. A splice 25 joins the upper end of motor lead 23 to power cable 27 In this embodiment, power cable 27 may be conventional and of a variety of types. Referring to FIG. 4, power cable 27 has three electrical wires 28, each having at least one layer of electrical insulation 30. An elastomeric jacket 32, which may be formed of a rubber material, is extruded around the three insulated wires 28. A helical metal strip of armor 34 is wrapped around jacket 32. Power cable 27 could be in either a flat or a round configuration, as shown. A lead sheath (not shown) could be extruded around the insulated wires 28.

Figure 2:
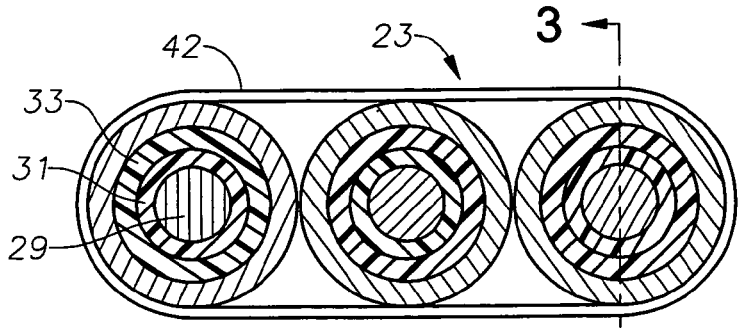
FIG. 2 is a horizontal sectional view of the motor lead of FIG. 1.

Referring to FIG. 2, motor lead 23 comprises three separate assemblies, each extending from motor 21 to splice 25. Each assembly includes an electrical conductor 29. An inner insulation layer 31 encases conductor 29. Inner insulation 31 has a high dielectric strength as well as being capable of withstanding high temperatures in the well. In the preferred embodiment, inner layer 31 is perfluoroalkoxy (PFA) or other high temperature material. An outer insulation layer 33 is extruded over inner insulation layer 31 in this embodiment. Outer insulation layer 33 is typically thinner in wall thickness and a different elastomeric material. Outer insulation layer 33 provides protection for inner insulation layer 33 and should also be able to withstand high temperatures. In one embodiment, the material may be of a type that swells when contact with a hydrocarbon fluid. In one embodiment, outer insulation 33 may be formed from an EPDM (ethylenepropylene-dienne) material. Alternately, a single layer of insulation of material such as PFA is feasible.

Each conductor 29 is located coaxially within a metallic impermeable tube 35. Preferably tube 35 is formed of a non-electromagnetic material, such as Monel, but other materials, such as stainless steel, are feasible. In the first embodiment, tube 35 has an annular crimp 37 formed therein at selected intervals, such as every few feet. Crimp 37 creates a sealed interface 39 within outer insulation layer 33. In this embodiment, an unsealed area 41 is located between outer insulation layer 33 and tube 35 between one crimp 37 and the next crimp 37. Unsealed area 41 may be a gap or clearance between outer insulation layer 33 and tube 35. Alternately, at least portions of unsealed area 41 may be in contact with outer insulation layer 33, but not sufficiently to form an annular seal. Unsealed area 41 provides expansion room for outer insulation layer 33 to thermally expand in the event that it expands more than the tube 35.

As shown in FIG. 2, in this example, tubes 35 touch each other and are wrapped with a metallic armor 42. Tubes 35 are preferably located in a flat or side-by-side configuration with a single plane passing through the axis of each tube 35. In the preferred embodiment, there is no elastomeric jacket surrounding tubes 37 within armor 42.

Figure 3:
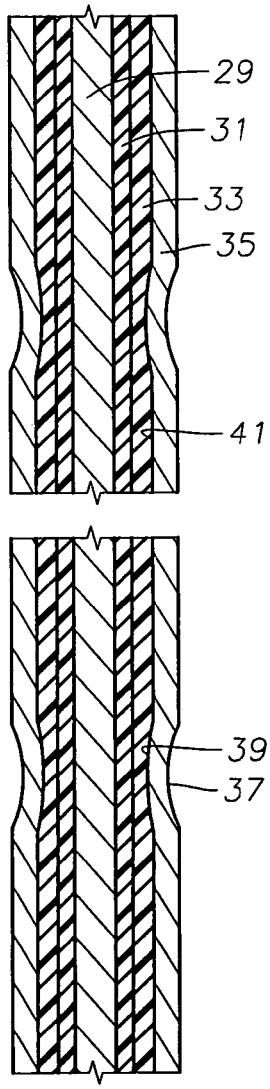
FIG. 3 is a sectional view of one conductor of the motor lead of FIG. 2, taken along the line 3-3 of FIG. 2.
Figure 5:
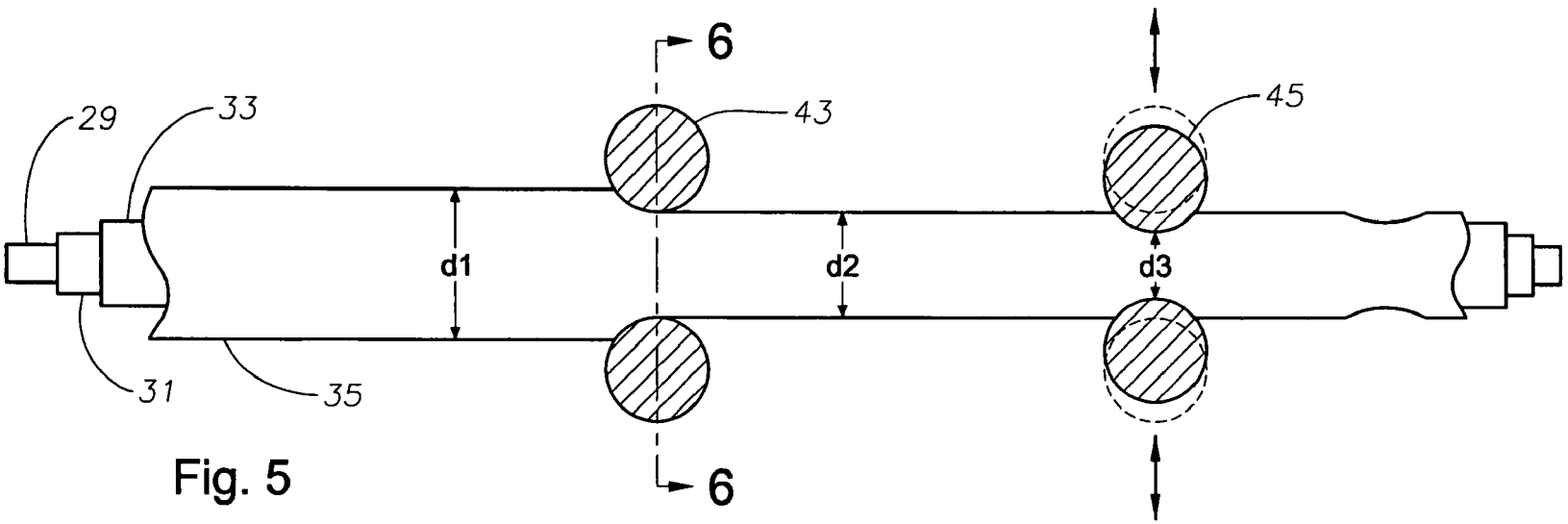
FIG. 5 is a schematic view illustrating a swaging process for forming the motor lead of FIG. 1.

FIG. 5 illustrates one method for forming each conductor assembly of FIGS. 2 and 3. In FIG. 5, insulated conductor 29 is initially formed separately then drawn by conventional techniques into tube 35. Alternately, insulated conductor 29 could be initially formed and placed within tube 35 while tube 35 is being bent from a strip and seam-welded.

After insulated conductor 29 is installed in tube 35, the assembly passes through a swaging process. Preferably a first set of swage rollers 43 reduces the initial diameter d1 of tube 35 to d2. Preferably unsealed area 41 would still exist between outer insulation layer 33 and the inner diameter of tube 35 in the section having a diameter d2. Then, at selected intervals, a second swage roller 45 forms crimps 37 (FIG. 3) or annular depressions. Each crimp 37 forms a tight annular seal with insulated conductor 29.

Figure 6:
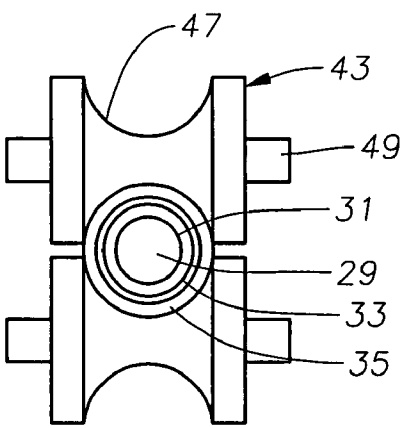
FIG. 6 is a sectional view of a first set of swaging rollers of FIG. 5, taken along the line 6-6 of FIG. 5.

As shown in FIG. 6, swage rollers 43 have concave contours 47 that define a diameter d2. Swage rollers 45 have similar contours to swage rollers 43, but define a diameter d3. At least one of the axles 49 of swage rollers 45 is capable of translational movement toward the other roller 45 to create a continuous 360 degree annular crimp 37 (FIG. 3). The dotted lines in FIG. 5 illustrated swage rollers 45 retracted and the solid lines show swage rollers 45 moved toward each other to form crimp 37.

After forming each tube 35 with an insulated conductor 29 as described, the operator will secure each conductor 29 separately to motor 21. The operator splices motor lead 23 to conventional power cable 27 at a desired distance above pump 15, as indicated by splice 25 (FIG. 1). Preferably tubes 37 are separately secured to motor 21 (FIG. 1) as described below and shown in FIGS. 10 and 11. Motor 21 (FIG. 11) has an adapter or head 50 on its upper end. Adapter 50 is a tubular member that forms part of the housing of motor 2 1. Adapter 50 has three separate slots 46 formed in an exterior portion of its sidewall. Slots 46 extend axially and are circumferentially spaced apart from each other defining a web 48 between each slot 52. Three threaded holes 52 are formed in the sidewall of adapter 50. Each hole 52 extends from one of the slots 46 to the interior in a generally downward direction.

A threaded fastener 54 secures sealingly into each of the holes 52. Each fastener 54 is secured sealingly to the end of one of the tubes 35 by a compression fitting 56. Each conductor 29 extends through fastener 54 into the interior of motor 21 where it will be joined to windings of the motor in any suitable manner. An annular clearance exists between outer insulation 33 and the inner diameter of fastener 54. While a separate seal could be employed in this clearance, there is no need for one. Motor 21 contains a dielectric, liquid for lubrication, and the lubricant migrates into the clearance surrounding outer insulation 33 within fastener 54. The positive seal at crimp 37 of outer insulation 33 with the inner diameter of tube 35 prevents lubricant from flowing up tube 35.

Figure 7:
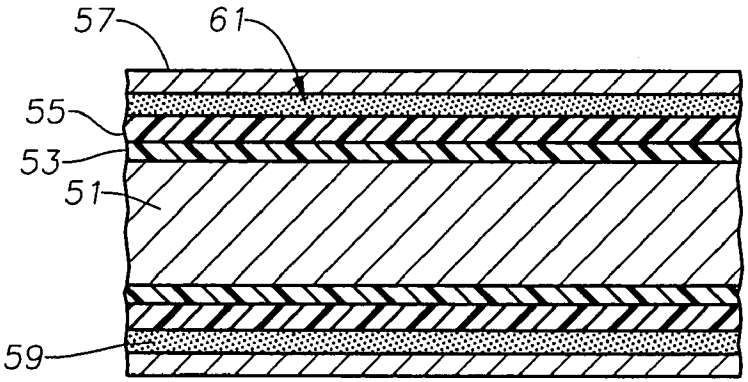
FIG. 7 is an enlarged schematic view of an alternate method for forming a motor lead for a power cable.

FIG. 7 illustrates a second embodiment. In this embodiment, a swaging process is not employed. Conductor 51 has one or more insulation layers 53, 55 that may be of the same type as in connection with the first embodiment. However, outer insulation layer 55 must be of a type that is capable of significant swelling when contacted with a hydrocarbon fluid, such as dielectric oil. Insulation layer 53, need not be the type that swells when contacted with a hydrocarbon, but it should be able to provide good electrical insulation and withstand high temperatures. Tube 57 has a greater inner diameter than the initial outer diameter of outer insulation layer 55. This results in an annular clearance 59. After insulated conductor 51 is installed within tube 57, the operator pumps a hydrocarbon, such as a dielectric oil 61, through the annular clearance 59. Oil 61 causes outer layer 55 to swell into tight, sealing contact with the inner diameter of outer tube 57.

If desired, one could also employ a dielectric oil to cause swelling of outer insulation layer 33 in the first embodiment. If so, the unsealed interface 41 would become a sealed interface. Crimps 37 would preferably be present to provide additional protection.

Figure 8:
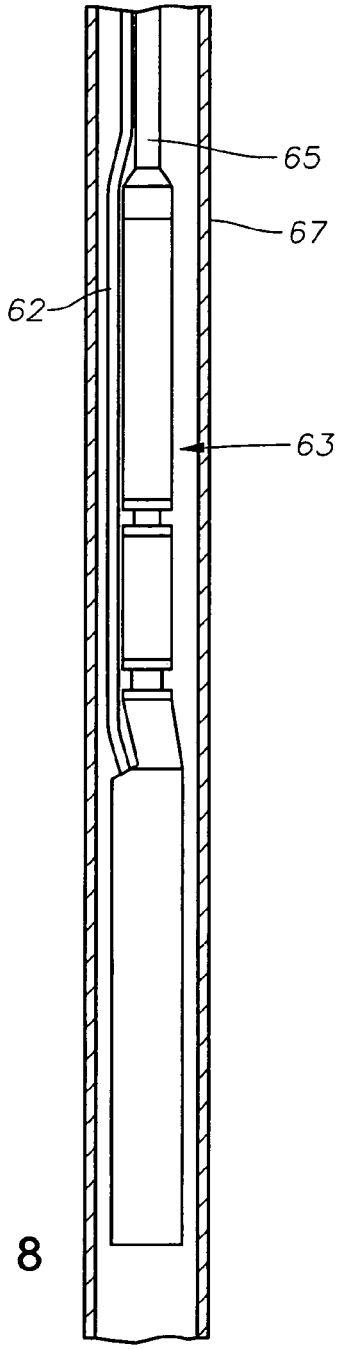
FIG. 8 is a schematic sectional view showing an electrical submersible pump assembly having an alternate embodiment of a power line, wherein both the motor lead and the power cable have three separate metal tubes incasing the insulated conductors.
Figure 9:
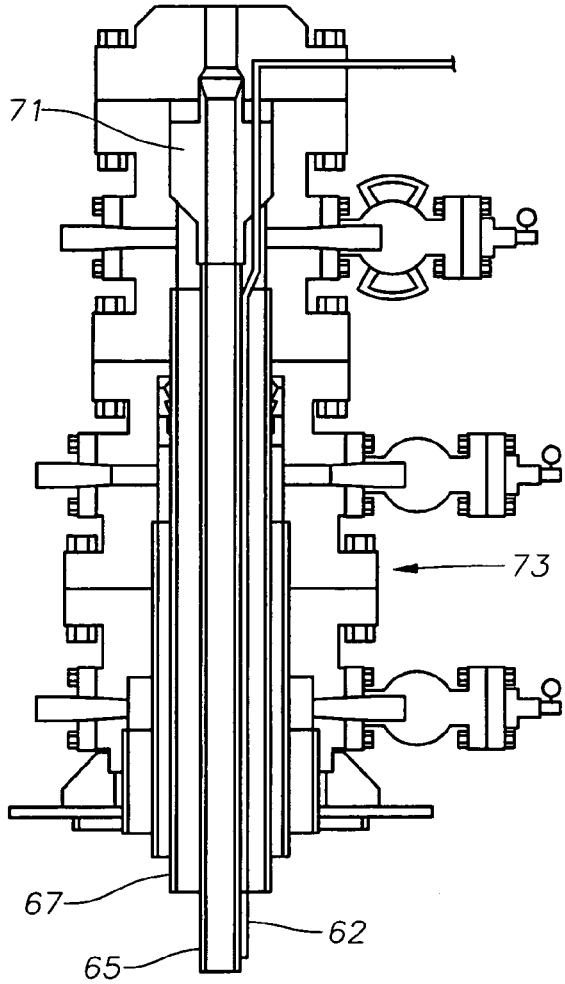
FIG. 9 is a schematic view illustrating a wellhead into which the power line of FIG. 8 extends.

In the embodiment of FIGS. 8 and 9, a power line 62 is employed that may be constructed either as the first embodiment employing crimps 37 (FIG. 3) or the second embodiment (FIG. 7) utilizing oil 61 to swell outer insulation layer 55 into sealing contact with tube 57. In either event, rather than utilizing a conventional power cable 27 (FIGS. 1, 4), motor lead 69 extends completely to the surface.

ESP assembly 63 is conventional and supported on a string of tubing 65 in the embodiment of FIGS. 8 and 9. The well has a casing 67 that extends to and is supported by wellhead assembly 73, shown in FIG. 9. A tubing hanger 71, located at the upper end of tubing 65, lands within wellhead assembly 73. Power line 62 extends to tubing hanger 71. Conventional penetrator assemblies pass sealingly through tubing hanger 71 to the exterior for connection to a surface power cable. Each electrical conductor 29 (FIG. 3) is electrically joined to one of the penetrators. For convenience in handling, the three tubes 37 shown in FIG. 2 may be secured together either by a continuous helically wrapped armor or by straps located at intervals along tubing 65.

Figure 10:
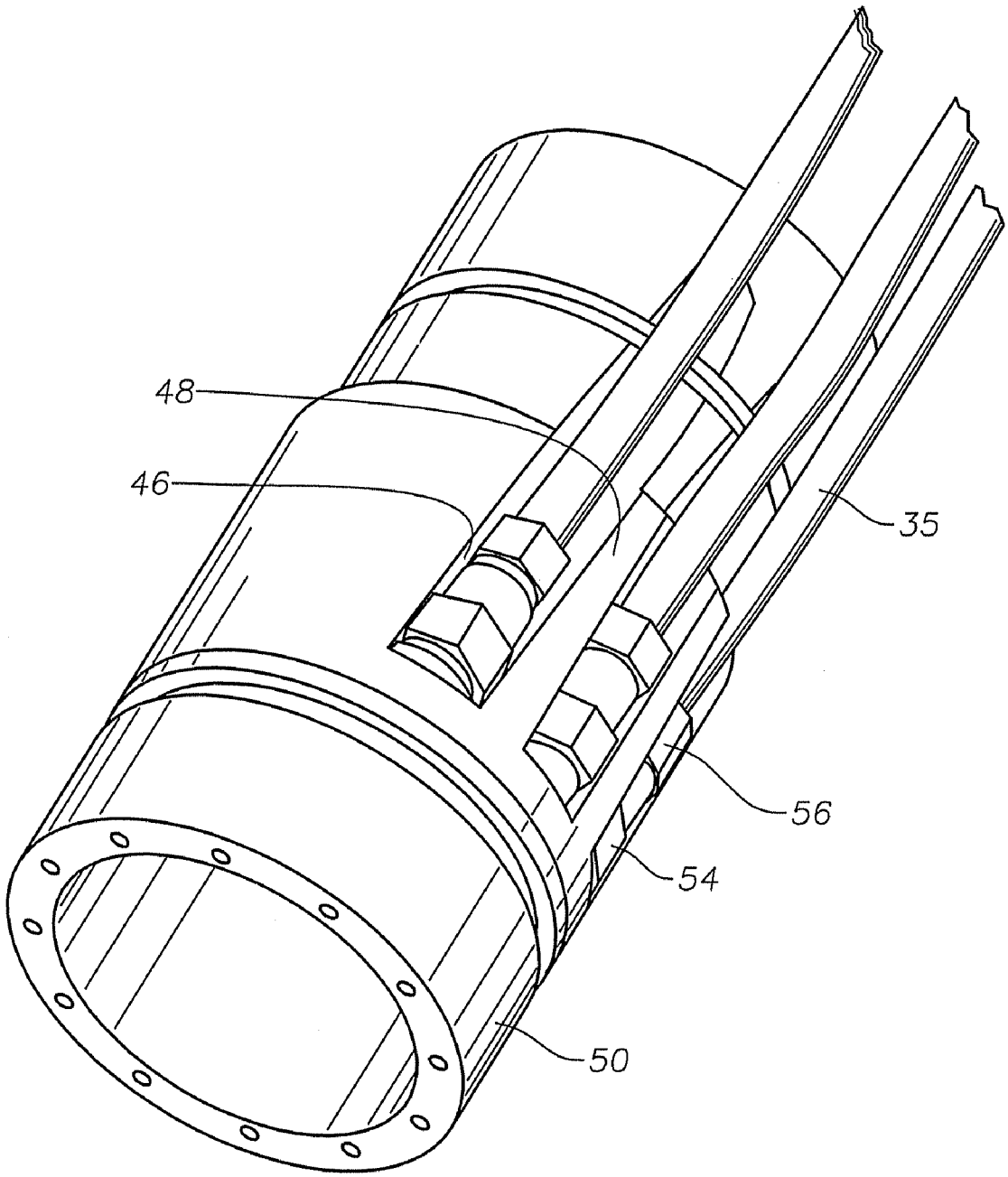
FIG. 10 is a perspective view illustrating the connection of the motor lead of FIG. 2 to a head of the electrical motor of FIG. 1.
Figure 11:
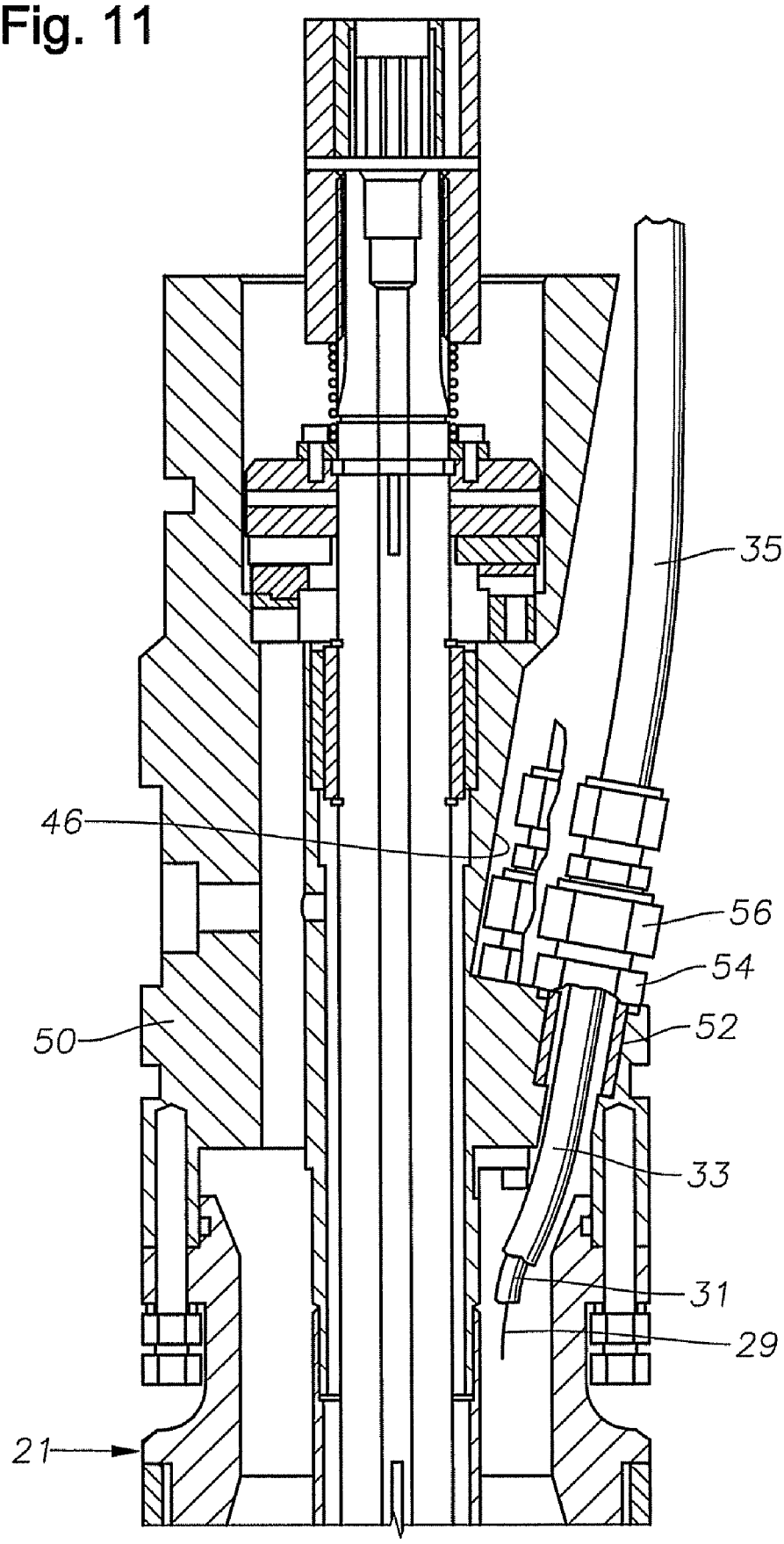
FIG. 11 is a sectional view of the motor lead and head of FIG. 10.

FIGS. 10 and 11 illustrate preferred connections of tubes 35, which may be secured to the connector 54 by compression fittings 56. Preferably, there is no seal around each individual insulated conductors 29 within the connector, rather the sealing is accomplished by tubes 35 and crimps 37 (FIG. 3).

The invention has significant advantages. The metallic tubes provide protection against the heat and harsh environment. Sealing the insulated conductors to the tubes at annular portions along the lengths provides additional protection in the event the tubes begin to leak. Leakage of well fluid through the tube would be limited. The individual conductors are farther part from each other than in a prior art motor lead or power cable, enhancing cooling. The separate holes and fasteners provide improved sealing of the conductors to the motor. The sealing system enables the motor to operate with a higher internal lubricant pressure than in the prior art. The individual tubes and conductors can be spliced at any point along the length without creating size issues that exist with prior art power cables.

While the invention has been shown in only a few of its forms, it should be apparent to those skilled in the art that it is not so limited but susceptible to various changes without departing from the scope of the invention.

We claim:

1. An apparatus for pumping well fluid, comprising:

a submersible pump;

a submersible electrical motor operatively connected to the pump, the motor having a housing with a cylindrical head at one end;

three slots formed in a sidewall of the head. the slots being spaced circumferentially apart from each other, defining a web between adjacent ones of the slots;

a passage leading from each of the slots into an interior of the housing;

three metallic impermeable tubes;

a fastener on each of the tubes, each of the fasteners being within one of the slots and securing one of the tubes to the head, the webs separating the fasteners from each other;

a single electrical conductor within each of the tubes, each of the conductors extending through one of the passages into the interior of the housing for supplying power to the motor;

at least one elastomeric insulation layer surrounding each of the conductors; and an annular portion of the insulation layer of each of the electrical conductors being in tight contact with the tube over at least a portion of the axial tube in which it is located to form a seal therebetween.

2. The apparatus according to claim 1, wherein each of the annular portions comprises a crimp formed in and circumferentially around each of the tubes, the crimps being at intervals along a longitudinal axis of the tube apart from each other.

3. The apparatus according to claim 1, wherein an unsealed area exists between the insulation layer and each of the tubes, other than at the seal, to accommodate thermal expansion of the insulation layer.

4. The apparatus according to claim 1, further comprising a dielectric oil in contact with the insulation layer within each of the tubes to cause swelling of the insulation layer to form the seal.

5. The apparatus according to claim 1, wherein the annular portions that form the seals are spaced apart from each other along a longitudinal axis of the tube, and an unsealed area exists between the insulation layer and each of the tubes in a section between adjacent ones of the annular portions to accommodate thermal expansion of the insulation layer.

6. The apparatus according to claim 1, wherein each of the annular portions comprises a crimp formed in and circumferentially around each of the tubes, the crimps being at intervals apart from each other alone a longitudinal axis of the tube; and each of the insulation layers has a coating of oil to cause swelling of the insulation layer within each of the tubes between adjacent ones of the crimps.

7. The apparatus according to claim 1, further comprising a power cable having three insulated wires located within a single elastomeric jacket, each of the wires being spliced to one of the conductors.

8. An apparatus for producing well fluid, comprising:

a wellhead member;

a tubing hanger landed in the wellhead member;

a string of tubing supported by the tubing hanger;

an electrical submersible pump and motor suspended on the string of tubing, the motor having a housing with a cylindrical head at an upper end and a longitudinal axis;

three axially extending slots formed in a sidewall of the head, the slots being spaced circumferentially apart from each other, defining a web between adjacent ones of the slots;

a passage leading from each of the slots into an interior of the housing;

three metallic impermeable tubes, each of the tubes being sealingly connected to the motor;

a fastener on each of the tubes, each of the fasteners being within one of the slots and securing one of the tubes to the head, the webs separating the fasteners from each other;

a single electrical conductor within each of the tubes for supplying electrical power to the motor, each of the conductors extending through one of the passages into the interior of the housing;

an elastomeric insulation layer surrounding each of the conductors; and a plurality of annular crimps formed circumferentially around and in each of the tubes at spaced intervals along a longitudinal axis of each of the tubes, each of the crimps being over at least a portion of the axial length of each of the tubes for forming seals between each of the insulation layers and each of the tubes.

9. The apparatus according to claim 8, wherein to accommodate thermal expansion of the insulation layers, a non-sealing area exists between each of the insulation layers and each of the tubes, the non-sealing area being located between adjacent ones of the crimps.

10. The apparatus according to claim 8, further comprising a hydrocarbon fluid in contact with the insulation layer to cause swelling of the insulation layer within each of the tubes.

11. The apparatus according to claim 8, further comprising a power cable spliced to the conductors at upper ends of the tubes and extending up to the tubing hanger, the power cable extending from the tubing hanger to the tubes and having three insulated electrical conductors, each having layer of elastomeric insulation and embedded within a single elastomeric jacket.

12. The apparatus according to claim 8, wherein each of the tubes extends continuously from the motor to the tubing hanger.

13. The apparatus according to claim 1, wherein the housing of the motor is filled with a dielectric liquid, and wherein the insulation layer within each of the tubes is in fluid communication with the dielectric liquid.

14. A method of supplying power to a submersible motor of an electrical submersible pump assembly, comprising:

(a) providing a motor with a housing having a cylindrical head, three axially extending slots formed in a sidewall of the head, the slots being spaced circumferentially apart from each other, defining a web between adjacent ones of the slots, and a passage leading from each of the slots into an interior of the housing;

(b) providing three metallic impermeable tubes, placing a fastener on each of the tubes, placing each of the fasteners within one of the slots and securing each of the tubes to the head with the fasteners so that the webs separate the Fasteners from each other;

(c) positioning an electrical conductors within each of the tubes such that each of the tubes contains a single one of the electrical conductors, each of the conductors having a layer of elastomeric insulation;

(d) causing an annular portion extending circumferentially around the insulation layer of each of the electrical conductors to be in tight contact with the tube in which it is enclosed to form a seal therebetween, the annular portion extending over at least a portion of the axial length of the tube; and (c) supplying electrical power to the conductors.

15. The method according to claim 14, wherein step (d) comprises crimping circumferentially around and in each of the tubes at intervals along a longitudinal axis of each of the tubes.

16. The method according to claim 14, wherein step (d) comprises contacting the insulation layer of each of the conductors with a hydrocarbon fluid to cause swelling of the insulation layer.

17. The method according to claim 14, wherein:

step (c) comprises providing an unsealed area between each of the insulation layers and each of the tubes; and step (d) comprises forming crimps circumferentially around and in each of the tubes at selected intervals along a longitudinal axis of each of the tubes and leaving portions of the unsealed area between the crimps to accommodate thermal expansion of each of the insulation layers.

18. The method according to claim 14, wherein step (c) comprises:

providing a power cable having three insulated wires surrounded by a common sheath;

splicing each of the wires to one of the conductors in one of the tubes; and extending the power cable from the conductors to a wellhead member.

19. The method according to claim 14, wherein step (b) comprises extending each of the tubes from the pump assembly to a tubing hanger supported in a wellhead housing.

* * * * *

UNITED STATES PATENT AND TRADEMARK OFFICE

CERTIFICATE OF CORRECTION

PATENT NO. : 7,611,339 B2
APPLICATION NO. : 11/211896
DATED : November 3, 2009
INVENTOR(S) : Steven K. Tetzlaff et al.

It is certified that error appears in the above-identified patent and that said Letters Patent is hereby corrected as shown below:

Column 3, line 30, delete "contact" and insert --contacted--

Column 4, line 37, after "dielectric" delete ","

Column 5, line 19, delete "conductors" and insert --conductor--

Column 7, line 5, after "having" insert --a--

Column 7, line 28, delete "conductors" and insert --conductor--

Signed and Sealed this

Seventh Day of September, 2010

David J. Kappos

David J. Kappos
*Director of the United States Patent and Trademark Office*